United States Patent [19]

Ward

[11] Patent Number: 4,729,587

[45] Date of Patent: Mar. 8, 1988

[54] PAINTER'S AID

[76] Inventor: Thomas D. M. Ward, 87 Gordon Parade, Manly, Queensland, 4178, Australia

[21] Appl. No.: 31,206

[22] Filed: Mar. 30, 1987

Related U.S. Application Data

[63] Continuation of Ser. No. 826,738, Feb. 6, 1986, abandoned.

[51] Int. Cl.[4] ..... A47F 13/06

[52] U.S. Cl. ..... 294/19.1; 15/146

[58] Field of Search ..... 294/19.1, 1.1, 7, 1.4, 294/27.1, 22, 23; 15/143 R, 144 R, 144 A, 146, 159 R

[56] References Cited

U.S. PATENT DOCUMENTS

| | | | |
|---|---|---|---|
| 1,335,616 | 3/1920 | Snyder | 15/146 |
| 1,599,273 | 9/1926 | Benkosky et al. | 15/146 |
| 2,057,225 | 10/1936 | Bermick | 15/146 |
| 4,060,047 | 11/1977 | Sabella | 15/144 R |
| 4,127,296 | 11/1978 | Thomson | 294/19.1 |

FOREIGN PATENT DOCUMENTS

| | | |
|---|---|---|
| 147004 | 6/1952 | Australia . |
| 78944 | 7/1981 | Australia . |

*Primary Examiner*—James B. Marbert

*Attorney, Agent, or Firm*—Oldham, Oldham & Weber Co.

[57] ABSTRACT

A painter's aid has a carrier for one or more paint brushes, the carrier being connected to the handle by an adjustable clamp which allows the orientation of the carrier to the handle to be carried about two axis.

3 Claims, 2 Drawing Figures

PAINTER'S AID

This application is a continuation patent application of application Ser. No. 826,738, filed Feb. 6, 1986, now abandoned.

BACKGROUND OF THE INVENTION (1) Field of Invention

This invention relates to a painter's aid.

(2) Prior Art

There are many instances where painters encounter undue difficulty in painting structures. On many tall buildings and on bridgework, it is often necessary to erect expensive scaffolding to enable the painter to reach all the areas to be painted. Difficulties arise also in painting factories which have high roofs with rows of suspended lights as the painter's scaffolding has to be demounted and re-erected each time he wishes to move between rows of lights. This naturally adds to the time and expense of painting the building.

The painting of roofs often presents further difficulties particularly as spray painting is often not allowed because of overspray problems, so that the painters must laboriously cover the whole roof using brushes. Where the roof is highly absorbant, e.g. of fibrous cement sheeting, the painter must have to apply two coats of paint to ensure adequate coverage.

SUMMARY OF THE PRESENT INVENTION

The present invention has been devised with the general object of providing a painter's aid device which will substantially reduce the said present difficulties.

With the foregoing and other objects in view, the invention resides broadly in a painter's aid including a carrier with a handle, a clamp on the carrier, mounting means connected by the clamp to the carrier and attachment means for attaching one or more paint brushes to the mounting means. The clamp preferably permits adjustable tilting of the mounting means about an axis transverse of the carrier, and the mounting means are preferably such that two or more paint brushes may be attached thereon by the attachment means in adjacent or superimposed manner. Other features of the invention will become apparent from the following description.

BRIEF DESCRIPTION OF THE DRAWINGS

In order that the invention may be readily understood and carried into practical effect, reference is now made to the accompanying drawings, wherein.

DETAILED DESCRIPTION OF THE PREFERRED EMBODIMENTS

Figure 1:
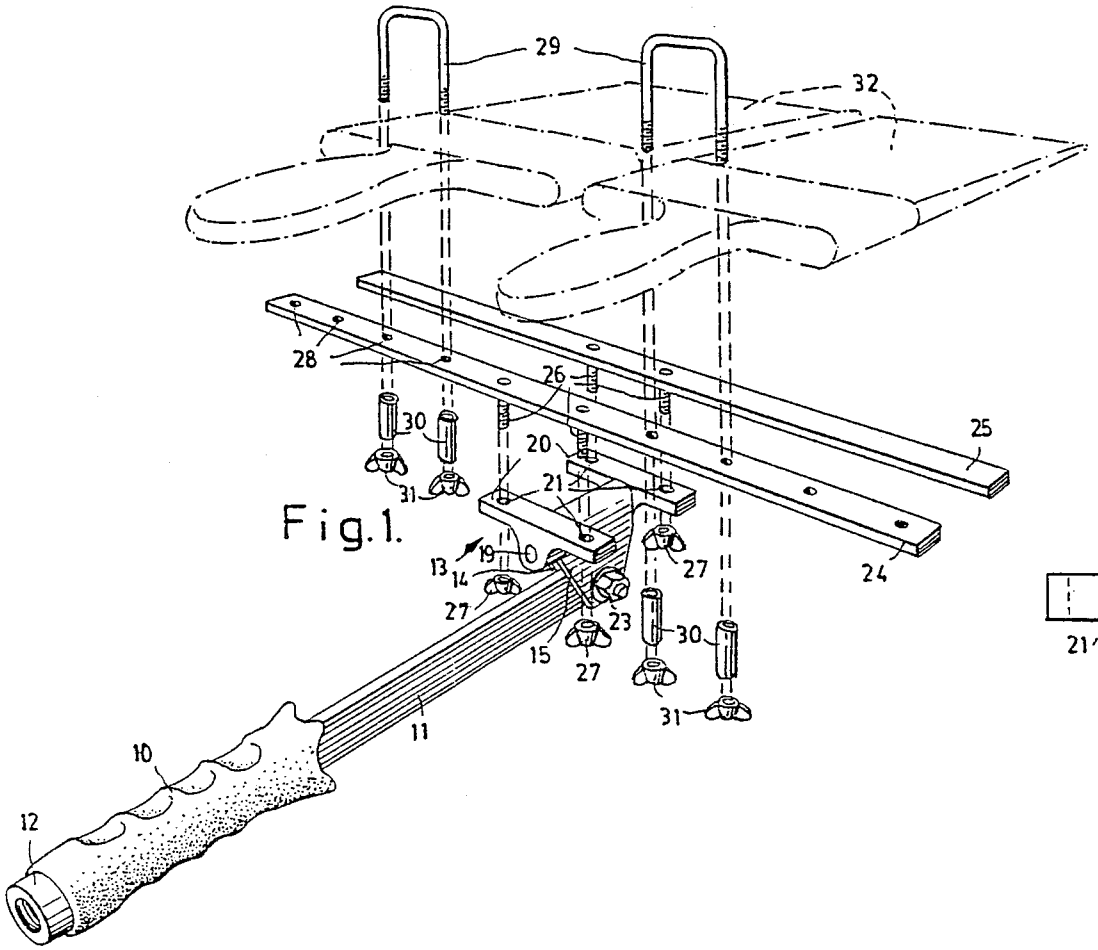
FIG. 1 is a partly exploded perspective view of a painter's aid according to a preferred embodiment of the invention.

The painter's aid shown in the drawings includes a handle 10 which may be of a suitable plastics material moulded about one end of a carrier bar 11 so that the bar extends from the front end of the handle, an internally threaded socket 12 being partly embedded in, and extending rearwardly from, the handle 10.

Figure 2:
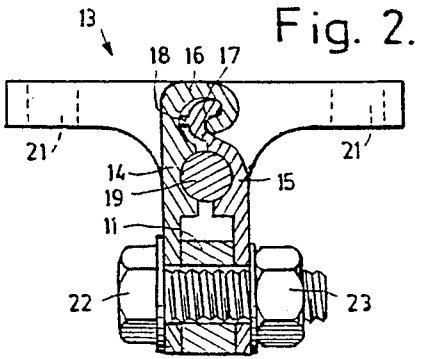
FIG. 2 is a cross-sectional view of the adjustable clamp of the device.

A double clamp device 13 is adjustably secured on the distal end of the carrier bar 11. This clamp, as shown particularly in FIG. 2, includes two clamp plates 14 and

15 which may be cut from extruded metal sections. The clamp plate 14 is formed at the top with a curbed flange or female part 16 to receive and engage hingedly a curved flange or male part 17 at the top of the clamp plate and formed with a small longitudinal guide rim 18. The inner faces of the two hingedly engaged clamp plates 14 and 15 are formed with complementary grooves to receive between them the major part of a shaft 19 which at both ends is fixed in the middle part of a pair of similar and parallel mounting brackets 20, each with bolt holes 21 through both sides. The front end of the carrier bar 11 is fitted between the lower parts of the clamp plates 14 and 15 and a clamp bolt 22 passes through registering holes in the two clamp plates and in the interposed end of the carrier bar, being then engaged by a nut 23 which, when tightened, locks the shaft 19 and mounting brackets 20 against rotation about the shaft axis and the clamp 13 against rotation relative to the carrier bar 11.

The device includes two detachable extension bars 24 and 25 each of which has extending from its middle part a pair of threaded studs 26 which may be freely passed through the bolt holes 21 in the two mounting brackets 20 and secured by wing nuts 27. The rear extension bar 24 is formed with a series of bolt holes 28 to both sides of the studs 26, and at similar spacing.

There are provided two U-bolts 29, each with associated spacer tubes 30 and wing-nuts 31.

Two conventional paint brushes, as indicated by chain-broken outline at 32 in FIG. 1, may be mounted adjacently on the painter's aid device, each brush being held firmly by a U-bolt 20 straddling the brush handle the arms of the U-bolt passing through a pair of the bolt holes 28 in the rear extension bar, through spacer tubes 30 and being engaged by the wing-nuts 31. The ferrule of the paint brush is then held against the front extension bar 25.

The two adjacent brushes will enable a painter to apply paint in fewer and broader strokes; and in some cases it may be desired to mount additional brushes adjacently by the use of further U-bolts 29. The double clamp 13 enables the brushes to be angled relative to the handle 10 and carrier arm 11 or to be skewed by rotational adjustment of the shaft 19 and mounting brackets 20 relative to the carrier bar 11.

In certain cases it may be advantageous for two of the paint brushes 32 to be mounted on the painter's aid in superimposed manner. In this event, the extension arms 24 and 25 may be removed, and a single U-bolt 29 may be used to hold the two superimposed brushes to the mounting brackets 20, the arms of the U-bolt passing through the bracket bolt holes 21, the spacer tubes 30, in this case, being omitted.

With the extension bars 24 and 25 fixed to the brackets 20, two pairs of superimposed paint brushes may be mounted adjacently on the device.

A single paint brush 32 may be fixed directly to the mounting brackets 20 by a single U-bolt 29, and the arrangement of the brush relative to the handle 10 may be readily adjusted appropriately for awkward painting situations.

When a particularly long reach is required, a supplementary handle (not shown) may be provided, the handle having extending from it an extension carrier bar or rod threaded for engagement in the socket 12 of the handle 10.

By means of a painter's aid according to the invention, then, a paint brush may be held in a position convenient for reaching into places otherwise likely to be inaccessible, and two or more paint brushes may be held adjacently or in superimposed arrangement to facilitate the application of paint over extensive and/or very absorbent areas requiring heavy paint coverage.

Although paint brushes according to the embodiment herein described and illustrated will be found to be very effecting in achieving the objects of the invention, it will, of course, be understood that many modifications may be made in constructional detail and design to the painter's aid without departing from the scope of the invention hereinafter claimed. In addition to paint brushes, other attachments may be fitted to the painter's aid, and these attachment may include sanding pads, steel brazing brushes, painter's knives, "Scarsten" (trade mark) scrapers and paint spray guns (fitted with remote controls for the triggers).

What is claimed is:

1. An improved painter's aid including in combination:

a carrier bar;

a double clamp mounted adjacent to the end of said carrier bar opposite its handle end, and paint brush mounting means for mounting one or more paint brushes, attached to said double clamp, wherein said double clamp comprises dual adjustable joints integrally combined in a single clamp structure, said double clamp permiting paint brushes mounted in said paint brush mounting means to be optionally, adjustably rotated relative to said carrier bar in a plane disposed at right angles to the longitudinal axis of said carrier bar; or adjustably tilted in a vertical plane parallel to the longitudinal axis of said carrier bar; or in both said planes, simultaneously, and wherein both the axes about which such adjustment is accomplished in each of said planes pass through said integral structure.

2. A painter's aid according to claim 1 wherein:

the mounting means includes a pair of brackets connected by a shaft releasably held in rotatably adjustable manner by the clamp; and the attachment means are capable of releasably securing one or more paint brushes to the brackets.

3. A painter's aid according to claim 2 wherein:

the mounting means include two extension bars releasably secured to the two brackets, a series of holes being formed in one extension bar; and the attachment means are U-bolts capable of engaging in the said one extension bar to secure thereto the handles of adjacent paint brushes the ferrules of which rest against the other extension bar.

* * * * *